US005603116A

United States Patent [19]

Tronc

[11] Patent Number: 5,603,116

[45] Date of Patent: Feb. 18, 1997

[54] TIGHT-FITTING GARMENT, NOTABLY FOR SPORTSWEAR SUCH AS DIVING SUITS

[76] Inventor: Nicolas Tronc, 46 Rue des Francs Bourgeois, 75003 Paris, France

[21] Appl. No.: 244,963

[22] PCT Filed: Dec. 18, 1992

[86] PCT No.: PCT/FR92/01206

§ 371 Date: Aug. 18, 1994

§ 102(e) Date: Aug. 18, 1994

[87] PCT Pub. No.: WO93/12677

PCT Pub. Date: Jul. 8, 1993

[30] Foreign Application Priority Data

Dec. 20, 1991 [FR] France ..... 91 16150

[51] Int. Cl.[6] ..... A41D 13/00

[52] U.S. Cl. ..... 2/2.15; 2/69; 2/161.1; 2/239; 2/272

[58] Field of Search ..... 2/2.15, 2.16, 239, 2/272, 2.17, 69, 82, 97, 101, 115, 90, 108, 161.1, 164, 168, 227, 67; 36/102, 7.3, 8.1, 4

[56] References Cited

U.S. PATENT DOCUMENTS

| | | | |
|---|---|---|---|
| 2,976,539 | 3/1961 | Brown, Jr. | 2/97 |
| 2,990,550 | 7/1961 | Locketz | 2/97 |
| 4,276,341 | 6/1981 | Tanaka | 2/2.16 |
| 4,420,521 | 12/1983 | Carr | 2/272 |
| 4,438,531 | 3/1984 | Long et al. | 2/2.15 |
| 4,569,874 | 2/1986 | Kuznetz | 2/272 |
| 4,783,858 | 11/1988 | Cheralier | 2/272 |
| 4,946,453 | 8/1990 | Monson | 2/2.15 |
| 5,098,770 | 3/1992 | Paire | 2/272 |
| 5,244,716 | 9/1993 | Thornton et al. | 2/239 |

FOREIGN PATENT DOCUMENTS

| | | | |
|---|---|---|---|
| 1379022 | 11/1964 | France . | |
| 2642277 | 3/1990 | France . | |
| 1268008 | 5/1968 | Germany | 2/2.15 |
| 8708364 | 3/1987 | Germany . | |
| 891998 | 3/1962 | United Kingdom | 2/2.16 |
| 978961 | 1/1965 | United Kingdom | 2/2.16 |
| 1313790 | 4/1973 | United Kingdom | 2/2.15 |

*Primary Examiner*—Amy B. Vanatta

*Attorney, Agent, or Firm*—Merchant, Gould, Smith, Edell, Welter & Schmidt

[57] ABSTRACT

Close-fitting garments, particularly diving suits and related footwear and gloves, are described. More generally, all kinds of garments that are so tight-fitting as to make dressing and undressing awkward are described. Therefore, a tight-fitting garment such as an item of sportswear, in particular a diving suit, including an outer layer (1) of a material having adhesive properties, is provided. The tight-fitting garment interacts with a film (2) of slippery non-porous material which is applied onto at least part of the internal surface thereof and has local openings or holes (23).

21 Claims, 2 Drawing Sheets

TIGHT-FITTING GARMENT, NOTABLY FOR SPORTSWEAR SUCH AS DIVING SUITS

BACKGROUND OF THE INVENTION

1. Field of the Invention

The field of the invention is that of tight-fitting garments, notably but not exclusively garments used in certain sports such as for example underwater diving (or any other aquatic sport requiring the use of a suit, gloves or shoes) or again in motorcycling.

The invention can be applied especially to diving suits as well as to the corresponding shoes and gloves.

More generally, the invention can be applied to all types of garments whose tight-fit makes it difficult to put on or take off.

2. Description of the Prior Art

Thus, it is known that it is fairly difficult to pull on a diving suit, notably because of its shape and its elasticity. Similarly, when a diver removes a diving suit, after having come out of the water, he has to make considerable efforts to get himself out of the suit.

The reasons for these difficulties can be found in several phenomena.

First of all, the constituent materials of the tight-fitting clothes are generally elastic and are stretched when worn by the user. It is this elasticity that gives the garment its tight-fitting character, but it also increases the forces of friction between the garment and the body when it is put on or taken off.

Furthermore, these materials are often of a porous type, for example neoprene for divers' suits or surfers' suits. Now, the pores of this material tend to expand in contact with the heat of the body. This gives rise to a sort of suction effect between the tight-fitting garment and the undergarments or the skin. This suction effect is increased by perspiration and by the possible penetration of sea water into the garment (in the case of a nautical sports suit), by external surface pressure when the garment is used in an underwater environment and probably also by the user's movements which contribute to the expulsion of air that may be trapped in the interstices when the garment is pulled on.

Besides, when the wearer comes out of the water, the water held between the suit and the body runs out almost entirely through the ends of the suit. However, because of the quantity of water remaining (through absorption by the material), the suit continues to adhere strongly to the skin by the same suction effect.

Users generally try different ways of putting on or removing their suits more easily. One of the known approaches consists in removing the suit while remaining in the water. However, with this method, not only is there very little reduction in the adherence but, furthermore, the difficulty of the operation in itself is often further increased.

Another approach consists in lubricating the interior of the suit. The lubrication, which is done for example with soap or a washing-up liquid, is not very effective and furthermore causes pollution. In general, the use of a lubricant is disagreeable and often ineffective, generally causes pollution, and is sometimes even chemically harmful to the body and the material constituting the suit.

The patent document FR-A-1 379 022, filed on 8 Oct. 1963 by Dubois and Beraud, describes a latex garment molded to the desired shape, to the back of which there is bonded a flexible and highly stretchable undervest. This undervest makes the garment pleasant to wear and preserves the heat of the body.

This document specifies that the undervest lining can be coated with a thin layer of plastic (or other material) to make it easier to pull on and prevent contact between the undervest lining and the skin.

However, a garment of this kind has numerous drawbacks. Thus, the fact that the skin slides on the thin layer of plastic (or other material), while it makes the garment easy to pull on, also means that the body is not held securely in the garment (the suction effect does not exist in this case) and may accidentally slip inside this garment.

Furthermore, a garment of this kind, wherein the skin is in contact with only a thin layer of plastic, does not permit the removal of perspiration.

Consequently, it can clearly be seen that, during intense physical effort, as is the case in underwater diving, wearing a garment such as this is neither safe (since the body is not securely held) nor pleasant.

An aim of the invention notably is to overcome these different drawbacks of the prior art.

More specifically, an aim of the invention is to provide means that make it easy to pull on as well as to remove a tight-fitting garment of the sportswear type, for example an underwater diving suit.

It is also an aim of the invention to provide a tight-fitting garment such as this that is pleasant to wear and holds the body in a perfectly secure way despite intense physical effort.

Another aim of the invention is to provide means such as these that are simple to use and cost little.

SUMMARY OF THE INVENTION

These aims, as well as others that shall appear hereinafter, are achieved according to the invention by means of a tight-fitting garment of the sportswear type, for example a diving suit, comprising an external layer made of a material having characteristics of adherence, wherein said garment cooperates with a film of non-porous material applied internally in contact with at least one surface portion of said tight-fitting garment, and wherein said film of non-porous material has gaps or holes locally.

Thus, the film of non-porous material improves sliding quality when a tight-fitting garment such as this is pulled on or removed.

Furthermore, through the holes or gaps, the water between the film and the skin can be discharged. The perspiration too can be discharged.

Finally, at the positions of the holes or gaps, the body is in direct contact with the material having characteristics of adherence. Consequently, with an accurate choice being made of the size and position of these holes or gaps, the body will not be able to pull on the film of non-porous material and will be held perfectly securely in the garment.

In a first embodiment, said film of non-porous material is fixedly joined to the tight-fitting garment. In this way, the skin slides on the film of non-porous material.

In an advantageous embodiment of the invention, said fixedly joined film is constituted by a layer of non-porous material deposited by spraying.

In a preferred embodiment of the invention, said fixedly joined film is constituted by at least one sheet of non-porous material joined at least by points or spots to said external layer.

In a second embodiment, said film of non-porous material is independent of the tight-fitting garment. Advantageously, said independent film is an undergarment. In this way, after an undergarment of this type has been pulled on, it becomes easy to pull on or remove a tight-fitting garment.

Advantageously, said undergarment is of the type belonging to the following group: jackets, shorts, trousers, vests, gloves, socks.

Advantageously, said undergarment has elastic tightening means at its ends. This prevents the undergarment from being pulled along when the tight-fitting garment is put on or taken off.

Advantageously, the tight-fitting garment includes means for being joined to said undergarment. Thus, after the tight-fitting garment has been pulled on easily owing to the undergarment, the fact that these two garments are joined together prevents subsequent sliding motions if any and ensures that the body will be held securely in a corresponding tight-fitting garment. Indeed, a suit for example, should always be fixed with respect to the body and should be a second skin so to speak. If not, in moving, the suit would become cumbersome.

Advantageously, said undergarment has surface portions with qualities of adherence. These qualities of adherence ensure that the body is securely held, a quality whose importance has been explained further above.

Advantageously, whatever the embodiment chosen, said non-porous material is a plastic, a polyethylene for example.

Furthermore, the invention also relates to a glove comprising a film applied internally in contact with at least one of the regions of the body belonging to the group comprising the palm and the back of the hand.

The invention also relates to a shoe comprising a film applied internally in contact with at least one of the regions of the body belonging to the group comprising the sole and the top of the foot.

In this way, whether it is for the glove or for the shoe respectively, the film of non-porous material placed on only certain parts of the hand or of the foot respectively makes it possible to preserve the sliding of the skin on the film of non-porous material and therefore makes it easy to pull on or remove the glove or the shoe respectively.

Furthermore, this also enables the hand or the foot to be held securely since, in certain places (the fingers and the toes), the skin is in direct contact with the external layer made of a material having characteristics of adherence.

BRIEF DESCRIPTION OF THE DRAWINGS

Other features and advantages of the invention will appear from the following description of a preferred embodiment of the invention, given by way of a non-restrictive example, and from the appended drawings, of which FIGS. 1 to 4 correspond to a first embodiment and FIGS. 5 to 8 correspond to a second embodiment. Of these figures.

MORE DETAILED DESCRIPTION

The garments described here below relate to underwater diving. It is clear however that they can easily be adapted to many other applications without departing from the context of the invention.

Two preferred embodiments shall be described successively with reference respectively to FIGS. 1 to 4 on the one hand and FIGS. 5 to 8 on the other.

The diver encounters many difficulties in pulling on his or her suit. Indeed, the external layer of the suit is made of a material, neoprene for example, having characteristics of adherence.

To make it easy to pull on the suit, the invention is based on the idea of greatly reducing the effect of adherence, usually encountered, by the adjoining of a complementary sliding element.

In a first embodiment described here below, the complementary sliding element is a film made of a non-porous material that is fixedly joined to the tight-fitting garment and facilitates the sliding of the unit formed by the garment and the film against the skin.

By contrast, in a second embodiment which also comes within the scope of the invention, the complementary sliding element is a film that is essentially independent of the tight-fitting garment, can be used as an undergarment and promotes the sliding of the tight-fitting garment on the film.

Figure 1:
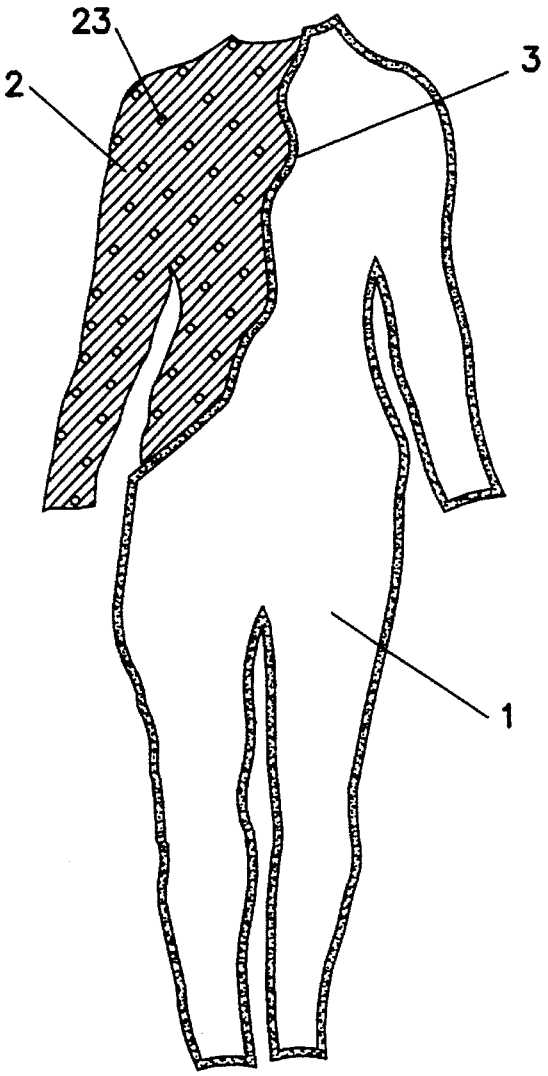
FIG. 1 shows a diving suit according to the invention with a part of the external layer of the suit not shown.

The suit, as represented in FIG. 1, shows the film 2 of the non-porous material, herein a macromolecular plastic, that at least partially lines the interior of the suit. Indeed, in this figure, a part of the external layer 1 of the suit has not been shown. A line 3 demarcates this part which is not shown. The plastic 2, shown by means of hatched lines, enables the skin to slide against the garment when a suit of this kind is pulled on or taken off.

Figure 2:
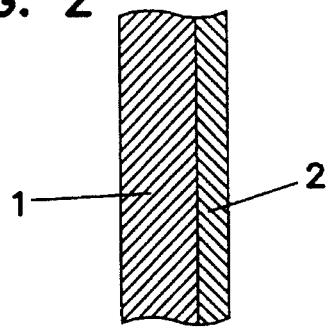
FIG. 2 shows a schematic sectional view of a portion of a suit as shown in FIG. 1.

FIG. 2 shows a schematic sectional view of a portion of a suit as shown in FIG. 1. The external layer made of neoprene 1 has characteristics of adherence. However, this external layer is lined with a plastic film 2. Thus, when a suit such as this is pulled on, the skin slides against the plastic 2.

The film 2 is made of plastic or any non-porous material enabling the skin to slide well against it.

The lining 2 may be constituted by a plastic layer deposited by spraying or a sheet of material fixedly joined at least by spots or points to the external layer 1 of neoprene for example by solders or stitches.

This film 2 of non-porous material has holes 23 locally.

In the embodiment shown, the holes 23 are distributed quincunxially and have a diameter or a size of the order of some millimeters. These holes 23 can be used to remove the perspiration as well as of water located between the film 2 and the skin.

As explained more specifically hereinafter for the gloves and the shoes, the film 2 of non-porous material can also have larger-sized holes or gaps locally.

At the positions of these holes or gaps, the skin is in direct clinging contact with the material having characteristics of adherence. Through an accurate choice of these positions (positions corresponding for example to the fingers, toes, heels, shoulders, etc.), the body is held in a perfectly secure way in the garment.

The gloves and the shoes are accessories that go with a diving suit.

Figure 3A:
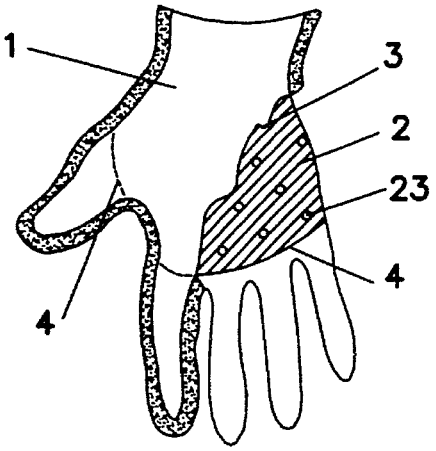
FIGS. 3A and 3B show the two sides of one and the same glove according to the invention with a part of the external layer of the glove not shown.
Figure 3B:
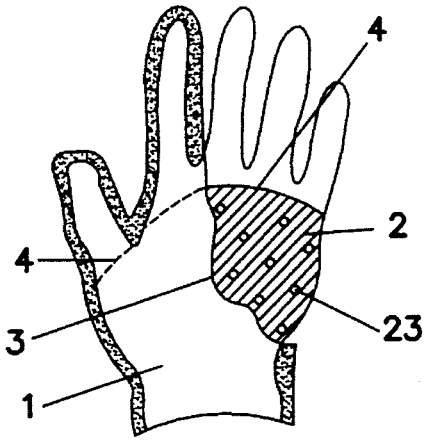

In FIGS. 3A and 3B, as in FIGS. 1 and 2, a part of the external layer 1 (generally) made of neoprene is not shown. A line 3 demarcates that part of the external layer 1 that is shown from the part that is not shown, revealing the plastic film 2.

So that the glove does not slip accidentally when it is put on, the film 2 has gaps and does not entirely cover the interior of the glove. A second line 4 demarcates the zone corresponding to the plastic film 2.

On one side, shown in FIG. 3A, only that part of the glove corresponding to the palm is lined internally with a plastic film 2. On the other side, shown in FIG. 3B, only that part of the glove corresponding to the back of the hand is lined internally with a plastic film 2.

Figure 4:
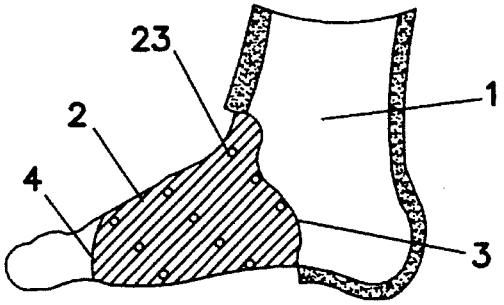
FIG. 4 shows a shoe according to the invention with a part of the external layer of the shoe not shown.

FIG. 4 shows a shoe. Only that part of the shoe corresponding to the top of the foot and to the sole is lined internally with a plastic film 2. Here too, this part is demarcated by a line 4.

The suit, glove and shoe shown respectively in FIGS. 1, 3A and 3B, and 4 are easy to pull on because the skin is not in contact with the neoprene 1 but with a plastic film 2 against which it slides easily. So that a member of the body can be held securely in a corresponding garment (the body in the suit, the hand in the glove or the foot in the shoe), the plastic film has gaps and does not entirely line the interior of said garment. The fingers and the toes, for example, are in direct contact with the neoprene thus preventing the glove or the shoe from accidentally slipping.

In a second embodiment of the invention, an undergarment comprises an external plastic film and is made entirely of plastic.

Thus, initially, the diver puts on different undergarments (vest, shorts, gloves and socks) and then, in a second stage, he can easily put on his diving suit, gloves and shoes. Indeed, since the undergarments have an external plastic film, this film slides on the neoprene when the suit as well as the diving accessories are put on or taken off.

If necessary, it can be seen to it that the garments and the undergarments are connected to one another at several end points (at the wrists or ankles) to prevent them from being mismatched or lost.

Figure 5:
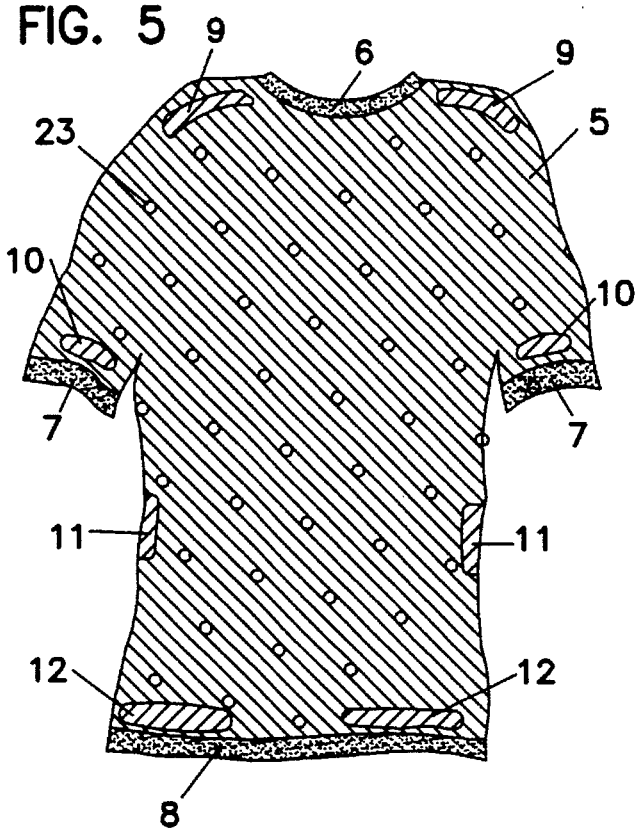
FIG. 5 shows a vest according to the invention.
Figure 6:
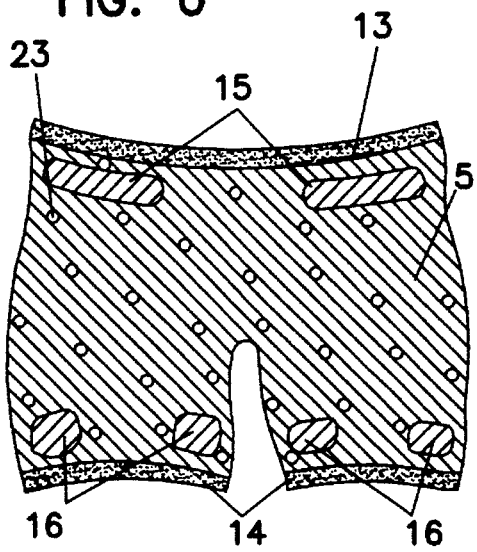
FIG. 6 shows a pair of shorts according to the invention.

FIGS. 5 and 6 respectively show a vest and a pair of shorts comprising an external plastic film 5 designed to slide against the neoprene of a suit that is put on or taken off.

Furthermore, this vest has elastic bands at the neck 6, at the sleeves 7 and at the waist 8 so that the vest can remain properly fixed to the body when the suit is put on or taken off and will not be pulled along even if the plastic film should slide against the neoprene.

Similarly, once the suit is put on, it should no longer slide against the undergarment. This is why the vest does not entirely cover the body (i.e. this is why it has gaps or holes) and also has self-adhesive bands located in the zones corresponding to the shoulder 9, the upper arm 10, the side 11 and the waist 12.

For the same reasons of fixing the undergarment to the body, and of fixing the suit to the undergarment, the pair of shorts also has elastic bands and self-adhesive bands.

The elastic bands are placed on the waist 13 and thighs 14. The self-adhesive bands are placed in the zones corresponding to the waist and to the upper thigh 16.

If the self-adhesive bands are Velcro (registered trademark) bands, the two complementary strips forming the Velcro band are located respectively on the undergarment and on the external layer of neoprene of the suit.

The invention also relates to a (jacket) and a pair of trousers having respectively the same characteristics as the vest and the pair of shorts described here above. The manufacture of these other two garments (jacket and trousers) follows in an evident way from that of the former two garments (vest and shorts).

Figure 7A:
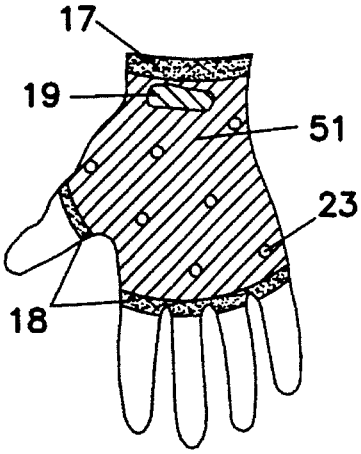
FIGS. 7A and 7B show both sides of one and the same glove according to the invention.
Figure 7B:
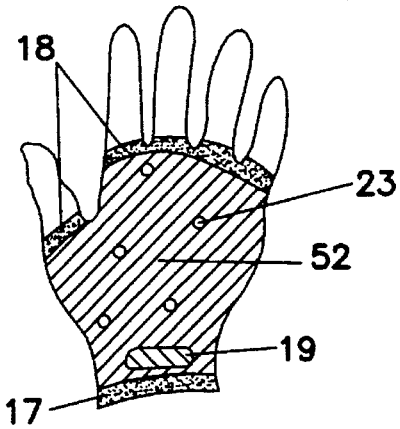

FIGS. 7A and 7B show both sides of one and the same glove. In the embodiment shown, the glove is actually a sort of mitten since it leaves the last two joints of the fingers bare. The plastic film 51, 52 lining this mitten therefore corresponds only to the palm 51 and to the back 52 of the hand.

As with the vest and the shorts, the glove, in order that it may be kept fixed to the hand, should include plastic bands at the wrist 17 and at the last joint of each finger 18 located on the palm side.

To keep the neoprene glove (the accessory of the diving suit) fixed to the glove (the undergarment lined with plastic film 5), the "undergarment glove" has two self-adhesive bands 19 located on each of the two sides of the wrist.

Figure 8:
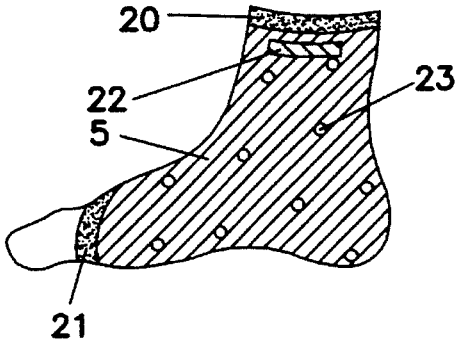
FIG. 8 shows a sock according to the invention.

FIG. 8 shows a sock lined with a plastic film 5 having elastic bands at the ankle 20 and the zone 21 located before the toes.

In the embodiment shown, the sock does not cover the toes.

Furthermore, the sock has adhesive bands 22 located on each side of the ankle.

Whatever the embodiment chosen, whether it is a tight-fitting garment lined internally with a film of non-porous material or an undergarment comprising an external film of non-porous material, the choice of oriented polyethylene as a non-porous material is very promising. Indeed, if care is taken to orient the polyethylene film along an axis perpendicular to the axis of the tensile forces exerted when the suit or the associated accessories are put on or taken off, the solidity of the polyethylene film is improved and it is prevented from tearing or getting out of shape.

The plastic film 2, 5, 51, 52 has gaps or holes 23. These holes enable the removal of the perspiration as well as the water located between the film 2 and the skin. Furthermore, these gaps or holes (when they are large-sized), can be used to hold the body securely in the tight-fitting garment while permitting direct contact between the skin and the material having qualities of adherence.

The invention is in no way restricted to the arrangement of holes or gaps as presented with reference to FIGS. 1 to 8.

During trials aimed at testing different types of plastic films, the inventor obtained good results with bags of the garbage disposal type, made of low-density polyethylene with a thickness of about 27 microns.

The above description relates to garments used for underwater diving. It is clear however that the invention can be extended to any other type of garment whose tight fitting to the body makes it difficult to put on or take off. The different garments according to the invention naturally have characteristics proper to the needs and/or functions related to their respective uses. Thus, it is possible to envisage many adaptations for garments of this kind without departing from the context of the invention.

What is claimed is:

1. A tight-fitting garment comprising:

an external layer made of stretchable material allowing perspiration and arranged to cling closely to a wearer's body, and an internal layer applied internally to said external layer;

said internal layer comprising at least one first portion extending in surface contact with a first area of the body, said first area of the body being an area of increased friction with said tight-fitting garment when putting on or removing said tight-fitting garment, said first portion being made of a film of slippery non-porous material and comprising a plurality of holes or gaps for allowing at least partial perspiration of said first area.

2. A tight-fitting garment according to claim 1, wherein the garment is adapted for underwater activities.

3. A tight fitting garment according to claim 1, wherein the internal layer is applied internally to an internal surface of the external layer.

4. A tight-fitting garment according to claim 1, wherein said internal layer is arranged to be applied internally to said external layer in contact with the body in a portion holding said internal layer perfectly securely within said garment.

5. A tight-fitting garment according to claim 1, wherein said internal layer is fixedly joined to the external layer by fixed joining means.

6. A tight-fitting garment according to claim 5, wherein said fixedly joined internal layer is constituted by a layer of non-porous material deposited by spraying.

7. A tight-fitting garment according to claim 5, wherein said fixedly joined internal layer is constituted by at least one sheet of non-porous material joined to said external layer at least by points or spots.

8. A tight-fitting garment according to claim 7, wherein said fixed joining means comprises bonding or stitching.

9. A tight-fitting garment according to claim 1, wherein said internal layer is independent of the external layer.

10. A tight-fitting garment according to claim 9, wherein said internal layer constitutes an undergarment.

11. A tight-fitting garment according to claim 10, wherein said undergarment is selected from the group consisting of:

jackets, shorts, trousers, vests, gloves, socks.

12. A tight-fitting garment according to claim 10, wherein said undergarment has elastic tightening means at its ends.

13. A tight-fitting garment according to claim 10, comprising means for being fixedly joined to said undergarment.

14. A tight-fitting garment according to claim 13, wherein said fixed joining means are selected from the group consisting of:

pressure buttons, zip fasteners, and self-adhesive tapes.

15. A tight-fitting garment according to claim 10, wherein said undergarment has surface portions with qualities of adherence.

16. A tight-fitting garment according to claim 1, wherein said non-porous material is a plastic.

17. A tight-fitting garment according to claim 16, wherein the plastic comprises:

polyethylene, low-density polyethylene, and oriented polyethylene.

18. A tight-fitting garment according to claim 1, wherein said holes or gaps are distributed quincunxially.

19. A tight-fitting garment according to claim 1, wherein said holes or gaps have a diameter or size of the order of a few millimeters.

20. A tight-fitting garment according to claim 1 in the form of a glove, wherein said internal layer is applied internally in contact with at least one of the regions of the body including to the group comprising the palm and the back of the hand.

21. A tight-fitting garment according to claim 1 in the form of a shoe, wherein said internal layer is applied internally in contact with at least one of the regions of the body including the sole and the top of the foot.

* * * * *

UNITED STATES PATENT AND TRADEMARK OFFICE

CERTIFICATE OF CORRECTION

PATENT NO. : 5,603,116

DATED : February 18, 1997

INVENTOR(S) : Nicolas Tronc

It is certified that error appears in the above-indentified patent and that said Letters Patent is hereby corrected as shown below:

Col. 8, line 3, claim 11: insert --and-- before the word "socks"

Col. 8, line 35, claim 20: "comprising" should read --including--

Signed and Sealed this

Twenty-first Day of October 1997

Bruce Lehman

*Attest:*

BRUCE LEHMAN

*Attesting Officer*

*Commissioner of Patents and Trademarks*